US012798047B2

(12) United States Patent
Khan

(10) Patent No.: US 12,798,047 B2
(45) Date of Patent: Nov. 17, 2026

(54) NOZZLE FOR SHOT PEENING AND SHOT BLASTING MACHINE

(71) Applicant: Gul Khan, Maple Grove, MN (US)

(72) Inventor: Gul Khan, Maple Grove, MN (US)

( * ) Notice: Subject to any disclaimer, the term of this patent is extended or adjusted under 35 U.S.C. 154(b) by 775 days.

(21) Appl. No.: 17/883,824

(22) Filed: Aug. 9, 2022

(65) Prior Publication Data

US 2023/0074518 A1 Mar. 9, 2023

Related U.S. Application Data

(63) Continuation-in-part of application No. 17/031,248, filed on Sep. 24, 2020.

(60) Provisional application No. 62/910,075, filed on Oct. 3, 2019.

(51) Int. Cl.
*B24C 5/04* (2006.01)
*B24C 1/10* (2006.01)

(52) U.S. Cl.
CPC . *B24C 5/04* (2013.01); *B24C 1/10* (2013.01)

(58) Field of Classification Search
CPC ..... B24C 5/04; B24C 1/10
See application file for complete search history.

(56) References Cited

U.S. PATENT DOCUMENTS 4,439,954 A * 4/1984 Bennett ..... B24C 5/02 239/246
5,050,805 A * 9/1991 Lloyd ..... B05B 1/002 239/DIG. 21
7,297,048 B1 * 11/2007 Reilley ..... B24C 7/0053 451/36
2005/0037697 A1 * 2/2005 Nord ..... B24C 5/04 451/102

OTHER PUBLICATIONS

CN104827408A (Shao) published on Aug. 12, 2015 Translation retrieved from Espacenet: https://worldwide.espacenet.com/patent/search/family/053805793/publication/CN104827408A?q=CN104827408A.*

* cited by examiner

*Primary Examiner* — Monica S Carter
*Assistant Examiner* — Christopher Soto
(74) *Attorney, Agent, or Firm* — Edwin E. Voigt, II

(57) ABSTRACT

The inventive nozzle has a pair of detachably connected nozzle sections, each section having a channel formed such that when the two detachably connected nozzle sections are connected to one another, at least one through passageway is formed. A hollow insert is shaped to fit into the at least one through passageway. The two detachably connected nozzle sections are formed of aluminum while the hollow insert is formed of a metal selected from the group consisting of chrome plate, tungsten carbide and boron carbide. This allows the nozzle to be lightweight for ease of manual operation while also providing adequate wearability against the shot passing through the nozzle and the two nozzle sections allowing for ease of replacing the hollow insert.

7 Claims, 8 Drawing Sheets

NOZZLE FOR SHOT PEENING AND SHOT BLASTING MACHINE

CROSS-REFERENCE TO RELATED APPLICATIONS

This application is a continuation-in-part of application Ser. No. 17/031,248 filed Sep. 24, 2020, which claims priority to provisional application No. 62/910,075, filed Oct. 3, 2019, the entire contents of each of which are incorporated by reference.

STATEMENT REGARDING FEDERALLY SPONSORED RESEARCH

Not Applicable

FIELD OF THE INVENTION

The invention is related to an improved nozzle for use with a shot peening, shot blasting machine, or attachment to any manual blast pot hose or shot peening hose, in which the nozzle is formed of two detachably connected pieces made from a lighter metal such as aluminum, with an insert made of a stronger metal such as chrome plate, tungsten carbide or boron carbide.

BACKGROUND OF THE INVENTION

Shot peening is a cold working process in which spheroidal media (CS—carbon steel or SS—stainless steel) are projected to the surface of the tool causing compressive and residual stresses. The media hammers the surface causing small indentations that produce shallow, rounded overlapping dimples stretching the surface radially creating compressive stress zones. Shot blasting is used to clean the surface of the tool, removing material. The inventive machine can be used for either shot peening or shot blasting.

Fatigue damage evolves progressively under cyclic stresses and strains at levels lower than the elastic limit of the material and results in cracks that initially can be difficult to detect. Under adverse situations and if not detected, such cracks can develop rapidly and cause sudden and brittle failure in structures. Fatigue damage emanates at sites where geometric changes give rise to stress concentration, this makes fatigue the most critical failure criterion in down-hole tools or pressure equipment used in the oil and gas industry. The shot peening process therefore has been used in improving fatigue properties, stress corrosion cracking, last but not least mitigating residual stress. The residual stress based methods mainly rely on either removing the tensile residual stresses or even introducing compressive residual stress which delays the formation and development of fatigue cracks.

Current single nozzle systems are either fixed, requiring a machine to rotate the pipe or use a manually held nozzle which can be very difficult to operate, to direct the shot to uniformly cover the area to be treated and which allow the shot to bounce all over the area, which can be dangerous to the operator and which is environmentally unfriendly.

The manually held nozzles are typically quite heavy as they have to be thick to provide adequate durability to the shot. What is needed is a lighter nozzle for the operator, but which can provide adequate durability to withstand the shot which is directed through the nozzle.

BRIEF SUMMARY OF THE INVENTION

The inventive nozzle is comprised of a pair of detachably connected nozzle sections, each section having a channel formed such that when the two detachably connected nozzle sections are connected to one another, at least one through passageway is formed. A hollow insert is shaped to fit into the at least one through passageway. The two detachably connected nozzle sections are formed of aluminum while the hollow insert is formed of a metal selected from the group consisting of chrome plate, tungsten carbide and boron carbide. This allows the nozzle to be lightweight for ease of manual operation while also providing adequate wearability against the shot passing through the nozzle and the two nozzle sections allowing for ease of replacing the hollow insert.

The passageway and the hollow insert are shaped to provide a venturi end to narrow the flow of shot at the nozzle end attached to the shot peening or shot blasting machine.

The nozzle outside surface has a rubber grip surface ease of handling.

The nozzle can be threadably connected to the shot peening or shot blasting machine or have a quick release connection.

The nozzle can also be configured to split the stream of shot into two streams.

The nozzle can further include a boron carbide insert which attaches to the nozzle to reinforce the point at which the shot splits into the two streams.

DETAILED DESCRIPTION OF THE INVENTION

Figure 1:
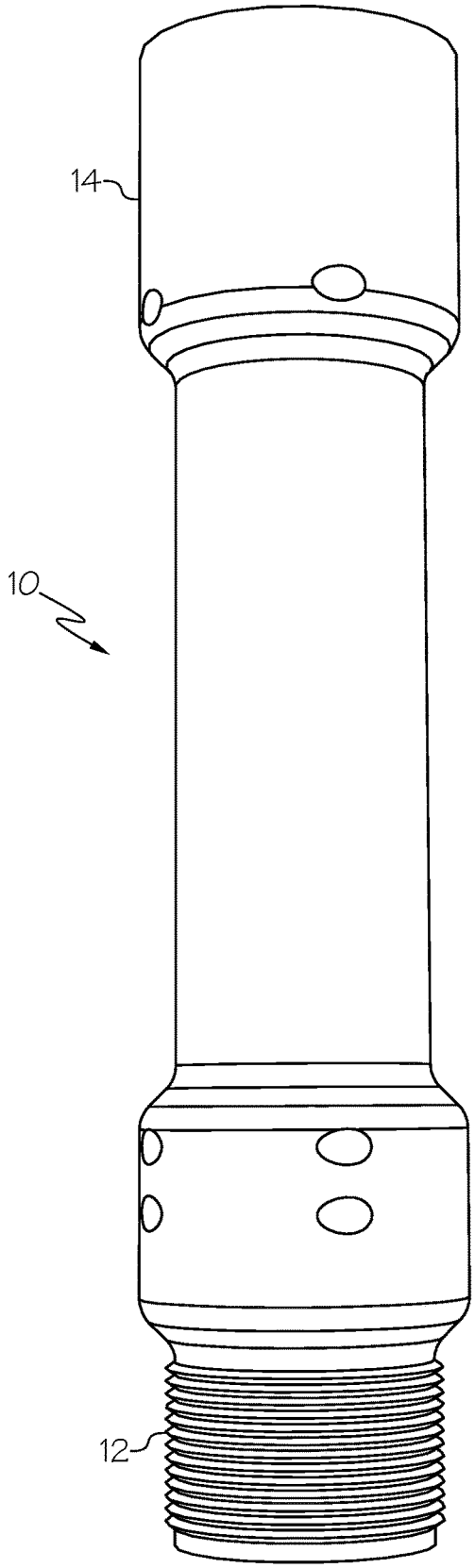
FIG. 1 shows a first embodiment of the inventive nozzle.
Figure 2:
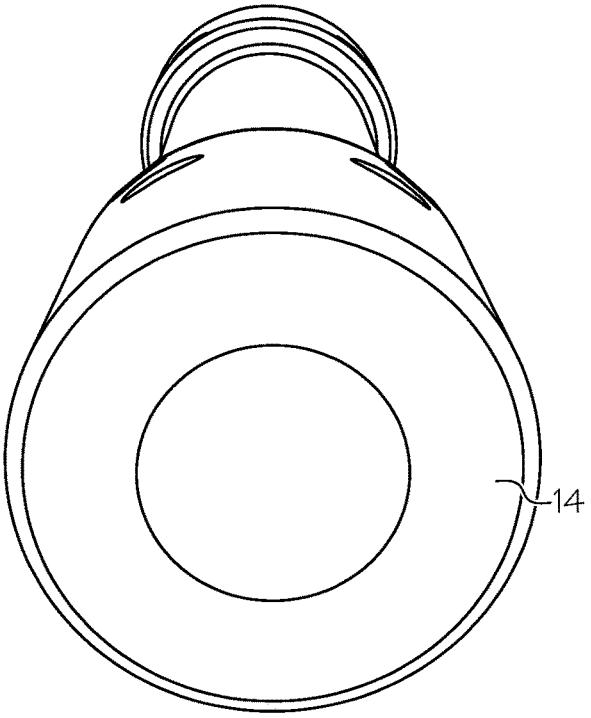
FIG. 2 shows a top view of the nozzle of FIG. 1.
Figure 3:
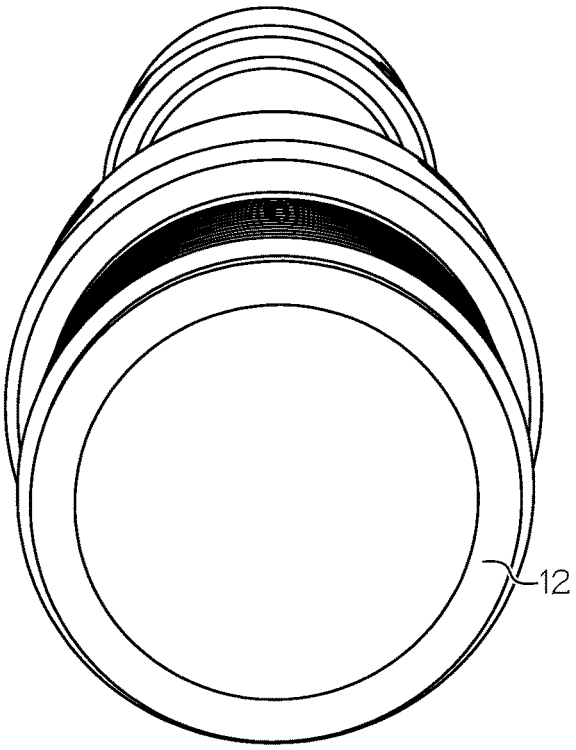
FIG. 3 is a bottom view of the nozzle of FIG. 1.
Figure 4:
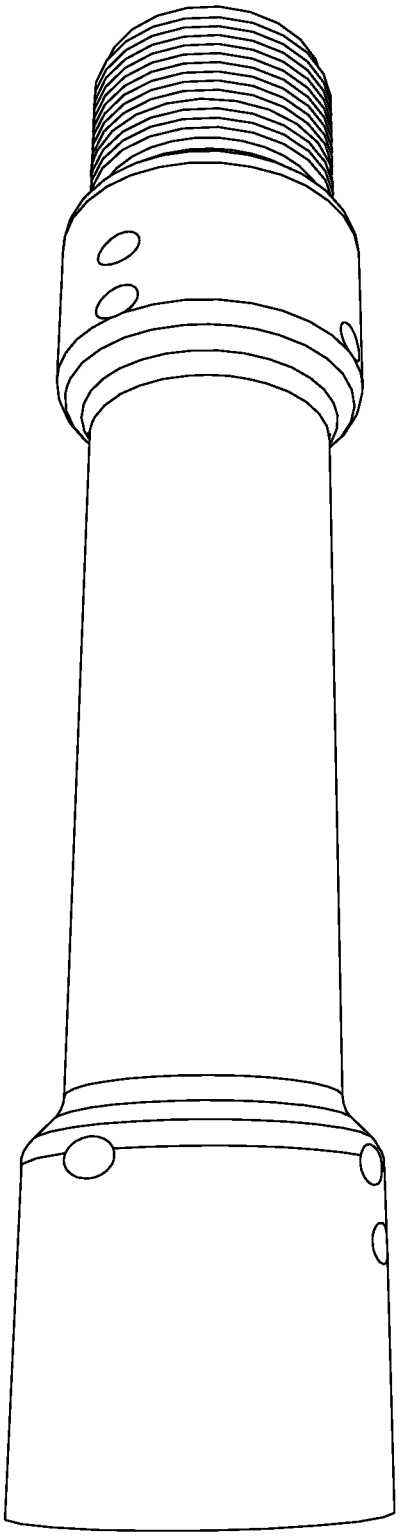
FIG. 4 is another view of the nozzle of FIG. 1.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 5:
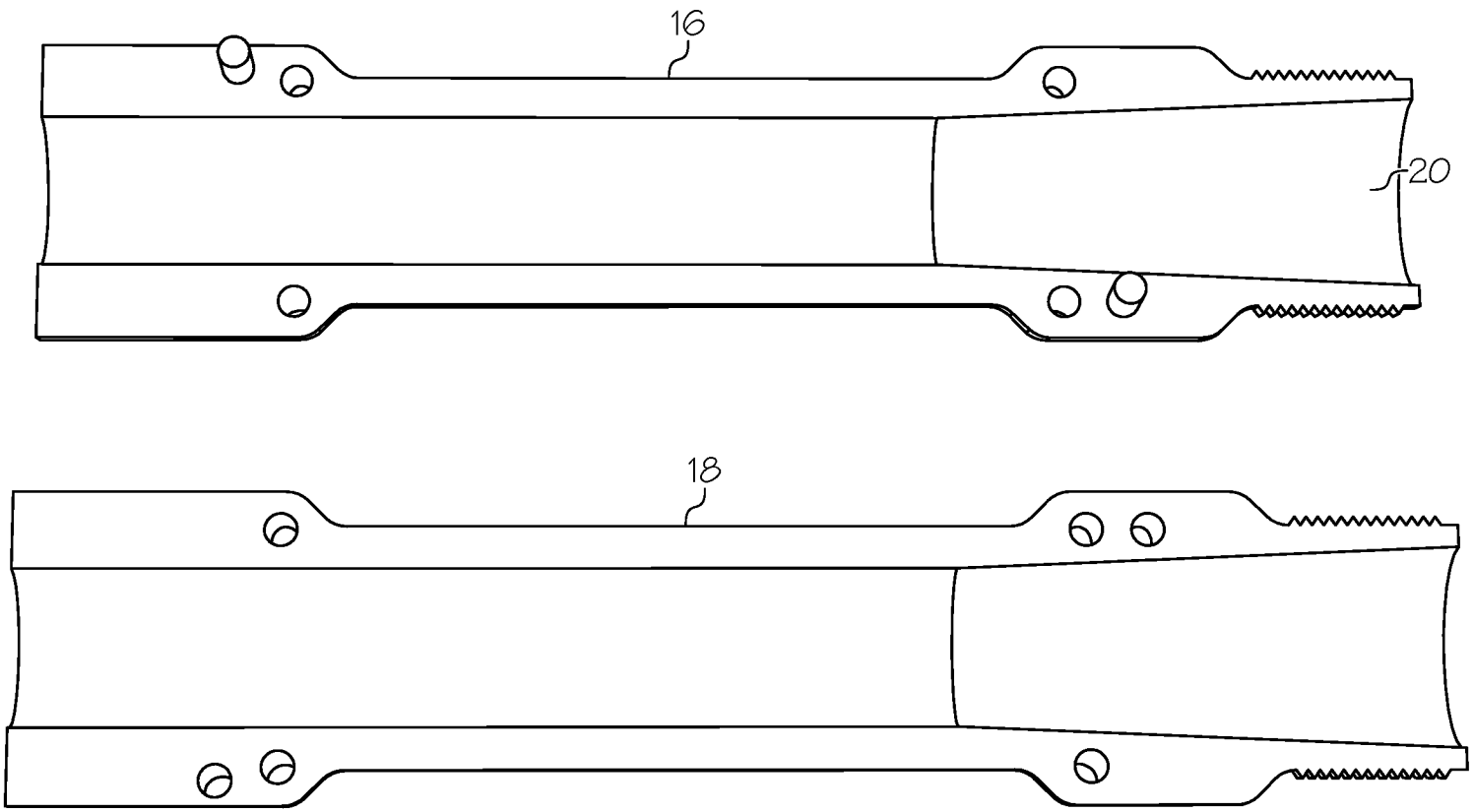
FIG. 5 is a view of the two parts of the nozzle, which are shown detached from one another.
Figure 6:
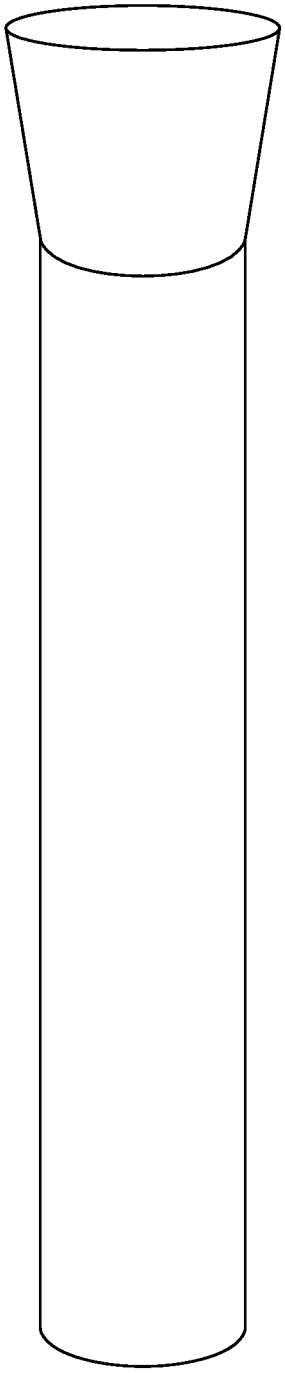
FIG. 6 shows the hollow insert which is sized to fit into the passageway formed when the two halves of FIG. 5 are connected together.

Referring now to FIGS. 1-6, a first embodiment of the inventive nozzle is shown in which the nozzle is shown generally at 10, and has two ends 12 and 14. End 12 is the end which attaches to the shot peening or shot blasting machine and is the end where the shot enters the nozzle. End 14 is the end through which the shot exits the nozzle. FIG. 5 shows the two halves of the nozzle 16 and 18, which can be detachable connected to form the nozzle of FIG. 1. Reference numeral 20 indicates the venturi shaped end which narrows the shot as it enters the nozzle. A hollow nozzle insert shaped to fit into the passageway formed when the two halves are connected together and which also has a venturi shaped end fits into the passageway. The halves or sections 14 and 16 are made from a lightweight metal such as aluminum, while the hollow insert shown in FIG. 6 is formed of a harder metal such as chrome plate, tungsten carbide or boron carbide. The inventive nozzle is lighter weight than prior art nozzles, which makes it easier to use manually, while also providing an insert for more durability and wearability, which is also easy to replace. The outside of the nozzle can include a rubber gripping surface for ease of use.

Figure 7:
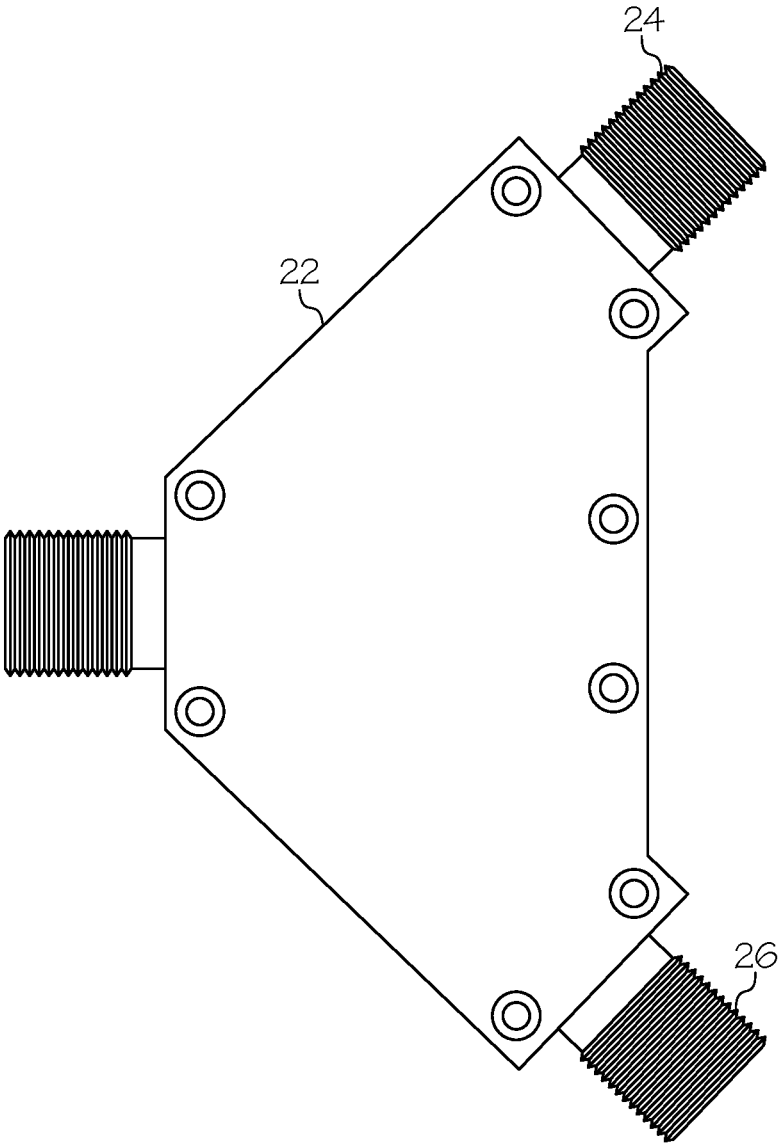
FIG. 7 shows a second embodiment of the inventive nozzle, which splits the shot into two streams.
Figure 8:
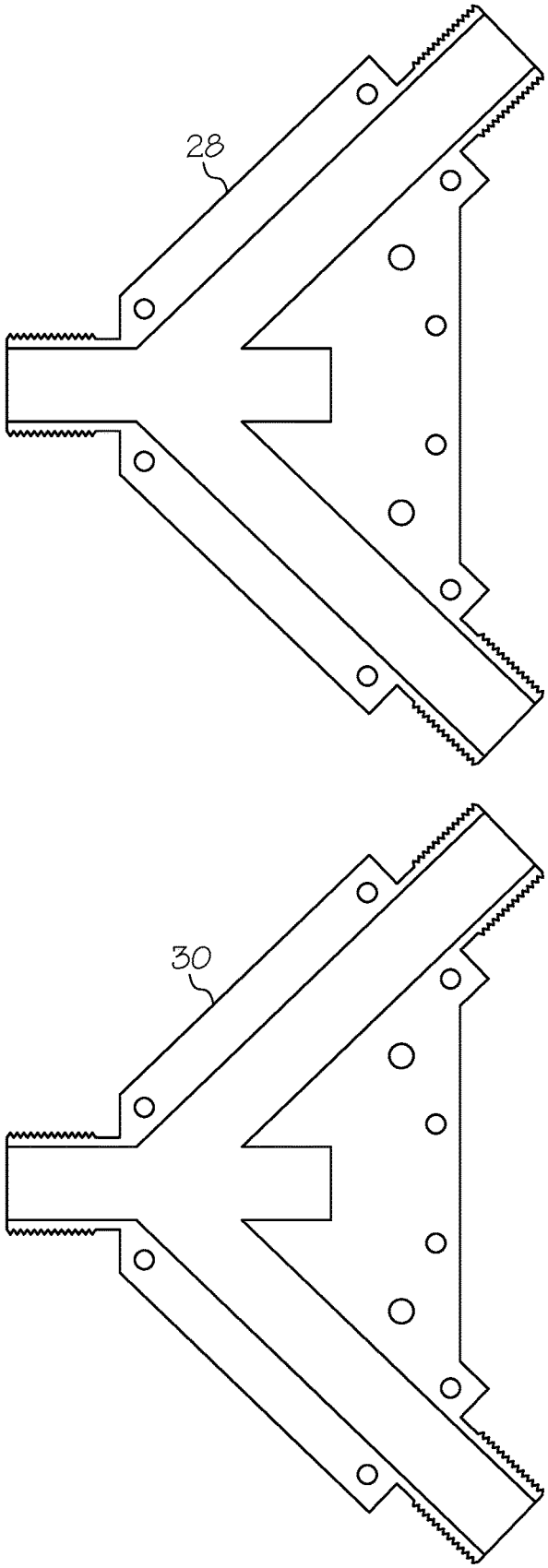
FIG. 8 is a view of the two parts of the nozzle of FIG. 6.
Figure 9:
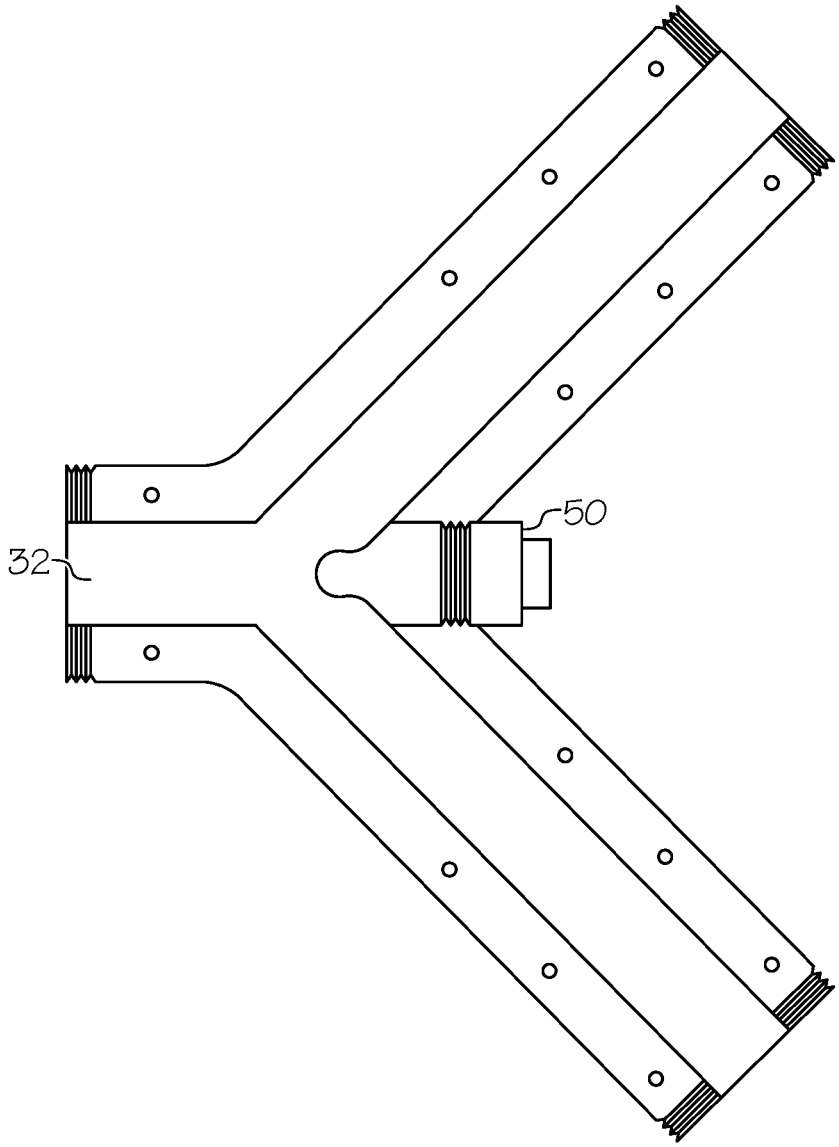
FIG. 9 shows a cross-section view of the nozzle of FIG. 6 showing the hollow insert and the reinforcing insert.

Referring now to FIGS. 7-9, a second embodiment of the inventive nozzle is shown generally at 22 which is designed to fit into a cabinet shot peening or shot blasting machine, such as that disclosed in parent application Ser. No. 17/031,248. This embodiment also has two nozzle sections 28 and 30 which can be detachable connected to each other, and with a hollow insert 22. However, this embodiment splits the stream of shot into two streams. A boron carbide insert 50 can be threadably attached to reinforce the point at which the shot splits into two streams.

What is claimed is:

1. A nozzle for a shot peening or shot blasting machine, comprising:

a pair of detachably connected nozzle sections, each section having a channel portion formed such that when the two detachably connected nozzle sections are connected to one another, at least one hollow through passageway is formed;

a hollow insert shaped to fit into the at least one hollow through passageway;

the two detachably connected nozzle sections formed of aluminum while the hollow insert is formed of a metal selected from the group consisting of chrome plate, tungsten carbide and boron carbide, whereby a nozzle is formed with the hollow insert when the pair of nozzle sections are connected to one another, providing adequate wearability against the shot passing through the nozzle and the two detachably connected nozzle sections allowing for ease of replacing the hollow insert.

2. The nozzle of claim 1 wherein the at least one passageway is shaped to have a venturi end where the nozzle attaches to the shot peening or shot blasting machine to narrow the flow of shot and where the hollow insert is shaped to have a venturi end to conform to the shape of the passageway.

3. The nozzle of claim 1 wherein the outside surface of the nozzle has a rubber grip surface.

4. The nozzle of claim 1 wherein the nozzle is threadably connected to the shot peening or shot blasting machine.

5. The nozzle of claim 1 wherein the nozzle has a quick release connection for connecting to the shot peening or shot blasting machine.

6. The nozzle of claim 1 wherein the at least one through passageway is constructed and arranged for splitting the shot into two streams.

7. The nozzle of claim 6 further including a boron carbide insert which attaches to the nozzle to reinforce the point at which the shot splits into the two streams.

* * * * *